US005909002A

United States Patent [19]

Atchisson

[11] Patent Number: 5,909,002

[45] Date of Patent: Jun. 1, 1999

[54] BUFFER FOR FIREARM

[76] Inventor: Maxwell G. Atchisson, 6695 Ridgemoore Dr., Doraville, Ga. 30360

[21] Appl. No.: 08/947,601

[22] Filed: Oct. 9, 1997

[51] Int. Cl.[6] ..... F41B 3/84

[52] U.S. Cl. ..... 89/130; 89/198; 89/199; 42/1.06

[58] Field of Search ..... 89/130, 198, 199, 89/44.01, 44.02; 42/1.06

[56] References Cited

U.S. PATENT DOCUMENTS

| | | | |
|---|---|---|---|
| 1,019,937 | 3/1912 | Whittier | 89/198 |
| 2,389,095 | 11/1945 | Vesely | 89/199 |
| 3,366,011 | 1/1968 | Sturtevant | 89/198 |
| 3,977,296 | 8/1976 | Silsby et al. | 89/198 |
| 4,057,003 | 11/1977 | Atchisson | 89/138 |
| 4,201,113 | 5/1980 | Seecamp | 89/199 |

FOREIGN PATENT DOCUMENTS

| | | | |
|---|---|---|---|
| 579278 | 7/1946 | United Kingdom | 89/198 |

*Primary Examiner*—Stephen M. Johnson

*Attorney, Agent, or Firm*—Jones & Askew, LLP

[57] ABSTRACT

A buffer assembly for use with firearms such as the M-16 rifle, for reducing the cyclic rate of firing in full-automatic operation. The buffer assembly includes a unit of length selected to stop the bolt carrier at the desired full-recoil position, and a mass movable relative to that unit. When the bolt carrier stops at full-recoil, inertia causes the mass to continue moving rearwardly while further compressing the action spring. The action spring then returns that mass forwardly to contact the fixed portion of the buffer assembly, returning the bolt carrier to battery position. The bolt carrier remains at rest in recoil while the moveable weight slides rearwardly and then returns forwardly relative to the bolt carrier, thereby increasing the cycle time of firing and correspondingly reducing the cyclic rate of fire for the firearm.

13 Claims, 4 Drawing Sheets

BUFFER FOR FIREARM

FIELD OF THE INVENTION

This invention relates in general to firearms capable of full-automatic operation, and relates in particular to an improved buffer for reducing the cyclic rate of fire for such firearms.

BACKGROUND OF THE INVENTION

Firearms capable of full-automatic operation often are not accurate unless fired in short bursts, for example, three rounds. This inaccuracy is caused by the tendency of the barrel to climb upwardly and to the right, with a right-handed shooter, due to the recoil of successive rounds fired at a high cyclic rate.

The M-16 rifle is an example of such a firearm. The M-16 fires at a cyclic rate of 750 rounds per minute (RPM), and that rate combined with the impulse of the 5.56 mm cartridge makes it difficult for a shooter firing full-automatic to produce a controlled pattern of shots.

The cyclic rate of fire for an automatic firearm is determined by various design aspects of the weapon. These aspects include the weight and recoil travel of the bolt assembly, the rate of the action spring required to absorb the recoil force and return the bolt assembly from recoil to battery positions, and other factors known to those skilled in the art. None of those factors is easily modified in an existing firearm. For example, adding weight to the bolt can somewhat lower the cyclic rate, but may lead to short recoils and thus reduce the reliability of the weapon. Changing the spring rate of the action spring in an effort to increase the cycle time may also reduce reliability.

One proposal for decreasing the cyclic rate of the M-16 rifle is found in U.S. Pat. No. 3,977,296. That patent discloses a hydraulic buffer assembly for substitution in place of the conventional buffer of the M-16. That hydraulic buffer does reduce the cyclic rate to an extent, but it is a relatively expensive device to produce. Furthermore, the rate-reducing effect of the hydraulic buffer tends to diminish during prolonged firing, as the hydraulic fluid in the buffer becomes heated.

Increasing the recoil distance (and therefore the recoil time) of the bolt assembly also will reduce the cyclic rate. However, the construction of an existing firearm may not permit any significant increase in travel, without extensive machining or other rebuilding of the receiver or other components. That extent of reworking, in turn, may interfere with the operation of the firearm.

SUMMARY OF THE INVENTION

Stated in general terms, the present invention reduces the cyclic rate of a firearm by delaying the return of the bolt assembly from its position of full recoil. This delay increases the time required for the bolt assembly to cycle between rounds, and thus reduces the cyclic rate of fire.

Stated somewhat more particularly, a buffer assembly according to the present invention includes a unit defining the maximum rearward travel of the bolt assembly in full recoil. A movable portion of the buffer assembly is movable relative to the unit and engages the action spring of the firearm. That movable portion continues to move rearwardly by inertia once the bolt assembly and the unit of the buffer assembly reach full recoil, and that continued rearward movement further compresses the action spring. The bolt assembly remains at its recoil position while the movable portion arrives at its maximum rearward extent of travel. The action spring then moves the movable portion forwardly to return to the full recoil position of the bolt assembly, whereupon the entire buffer assembly and the bolt assembly then commence forward movement to the battery position. The time required for the movable portion of the buffer assembly to move rearwardly under its inertia and then return to the full-recoil position of the bolt assembly thus increases the cycle time between rounds, and produces a corresponding reduction in the cyclic rate of fire.

Stated somewhat more particularly, the buffer assembly of the present invention includes an elongated unit having front and rear ends spaced apart from each other. The spacing between the front and rear ends of the elongated unit defines the maximum rearward position of the bolt assembly in recoil, when the buffer assembly according to the present invention is in place in the firearm. This maximum recoil position preferably, although not necessarily, is unchanged from the normal full-recoil position of the firearm equipped with a conventional buffer. The present buffer assembly also includes a mass mounted for movement relative to the elongated unit between the front and rear ends thereof. This mass engages the action spring of the firearm in which the buffer assembly is installed, so that the action spring urges the mass forwardly to contact the front end of the elongated unit. The mass may either be a unitary mass provided by a single weight, or alternatively may be a plurality of separate weights serially mounted for reciprocal movement relative to the elongated unit of the buffer assembly.

When firing a round in a firearm equipped with the present buffer assembly, the bolt assembly travels rearwardly in the usual manner, moving the buffer assembly rearwardly and compressing the action spring until the bolt assembly reaches full-recoil position, as determined by the buffer assembly. However, the inertia of the mass causes the mass to continue moving rearwardly, further compressing the action spring. When the mass travels to its maximum rearward position, determined either by contacting the rear end of the elongated unit or by the force of the compressed action spring, the mass begins moving forwardly relative to the elongated unit of the bolt assembly. The mass continues moving forwardly under the influence of the action spring until the mass contacts the front end of the elongated unit, at which time the entire buffer assembly and the bolt assembly commence traveling forward from the full-recoil position. The bolt assembly then continues its forward movement in the usual manner, chambering a new round for firing if the trigger remains pulled.

Accordingly, it is an object of the present invention to reduce the cyclic rate of fire of a firearm.

It is another object of the present invention to provide an improved buffer assembly for use with firearms.

It is a further object of the present invention to provide an improved buffer assembly that reduces the cyclic rate of fire for a firearm capable of full-automatic operation.

It is yet another object of the present invention to provide a buffer assembly that increases the cycle time of a firearm, thereby reducing the cyclic rate of fire.

Other objects and advantages of the present invention will become more apparent from the following description of preferred embodiments thereof.

DETAILED DESCRIPTION OF PREFERRED EMBODIMENT

Figure 1:
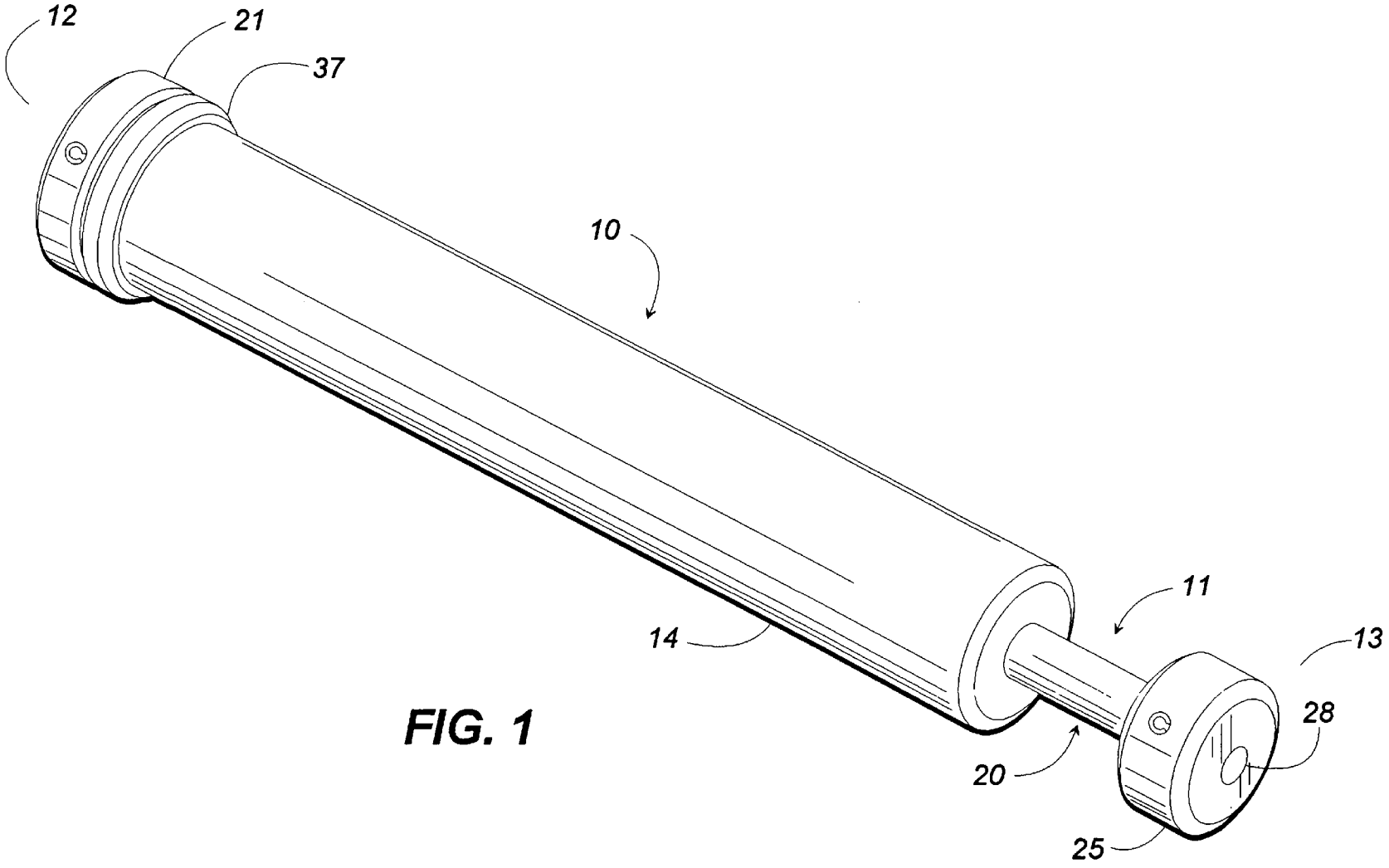
FIG. 1 is a pictorial view showing a buffer assembly according to a first embodiment of the present invention.
Figure 2:
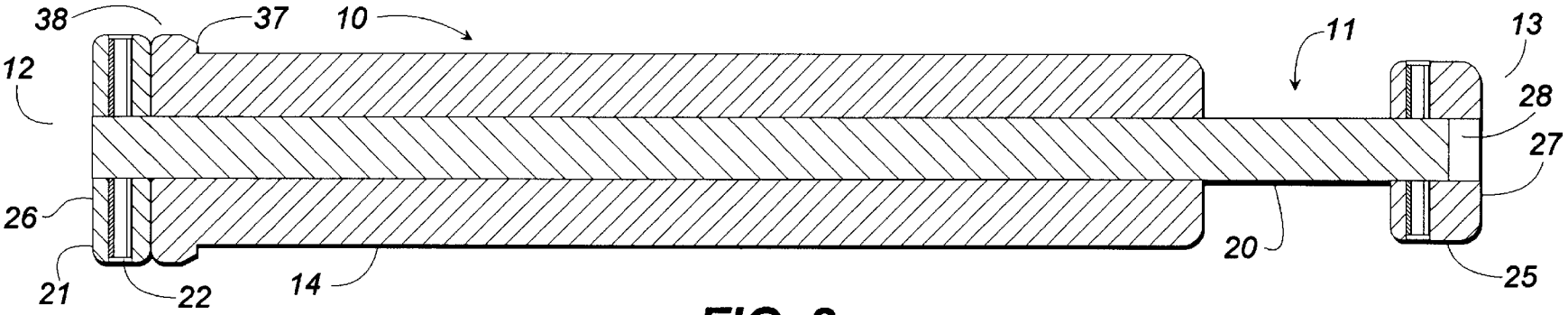
FIG. 2 is a section view taken along line 2—2 of FIG. 1.

Turning first to FIGS. 1 and 2, there is shown generally at 10 a buffer assembly according to the present invention and designed for use with an M-16 rifle. The buffer assembly 10 comprises a unit 11 of fixed length extending between a front end 12 and a rear end 13, and a mass 14 carried by the unit for movement between the front and rear ends. The entire buffer assembly 10 is configured to fit within the action spring tube 18 of a conventional M-16 rifle 15, FIG. 4, replacing the conventional buffer of that rifle.

The unit 11 of the buffer assembly 10 includes a rod 20 of circular diameter. At the front end 12, the rod 20 is secured to a front buffer 21 by a roll pin 22 extending in a hole through the diameter of the front buffer and through a mating hole extending through the diameter of the rod near the front end of the rod. A rear buffer 25 similarly is attached to the rod 20 at the rear end 13 of the buffer unit 11.

Both the front buffer 21 and the rear buffer 25 have the shape of circular disks. However, as best seen in FIG. 2, the front end of the rod 20 is substantially flush with the front face 26 of the front buffer, while the rear end of the rod is inset from the rear face 27 of the rear buffer through the hole 28 receiving the rod. In practice, the front end of the rod 20 may be inset approximately 0.010 in. from the front face 26 of the front buffer, to provide nominal clearance for an element (not shown) on the bolt carrier assembly 31 (FIG. 4) contacted by the front end 12 of the buffer unit 10. Because the rear end of the buffer unit 11 strikes the back wall 32 of the tube 18 containing the action spring 36, recessing the corresponding end of the rod 20 within the rear buffer 25 is necessary to prevent damaging the back wall and to cushion the effect of recoil on the shooter.

The mass 14 comprises an elongated cylindrical member having an axial bore through which the rod 20 fits. The mass is freely slideable back and forth along the rod. The overall length of the mass 14 is less than that of the rod 20, so that the mass is moveable between the front buffer 21 and rear buffer 25 of the unit 11 composed of the two buffers and the rod. In an actual embodiment of the buffer shown in FIG. 1 intended for a standard M-16 rifle, the overall length of the buffer assembly is 5.875 in. and the length of the mass 14 is 0.75 in. less than the length of the rod 20 measured between the confronting inner faces of the front buffer 21 and rear buffer 25. Other dimensions may be more appropriate for a buffer intended for use in another model of teh M-16 or in a different firearm.

The buffer assembly 10 telescopically fits within the front end 35 of the action spring 36 (FIG. 4) associated with the rifle. The exterior diameter of the mass 14 thus is less than the diameter inside the coils of the action spring, so that the buffer assembly is free to reciprocate within the tube 18 and within the action spring 36 contained in that tube. To engage the front end 35 of the action spring, an enlarged region in the form of a flange 37 is formed at or near the forward end 38 of the mass. The action spring 36 within the tube 18 thus operates in compression between the flange 37 on the mass and the back wall 32 of the spring tube 18.

Figure 3:
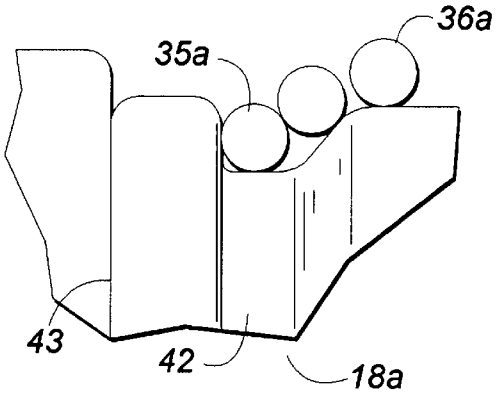
FIG. 3 is an enlarged fragmentary view showing a modified version of the buffer assembly in FIG. 1.

FIG. 3 shows an alternative construction of a mass 18*a* for engaging the front end 35*a* of a modified action spring 36*a*. Instead of a flange of greater diameter than the body of the mass, as in FIG. 1, the modified mass 18*a* has an annular groove 42 formed around the exterior surface of the mass. The groove 42 is located on the mass 18*a* a short distance inwardly from the front end 43 of the mass. The diameter of the action spring 36*a* at its front end 35*a* is reduced as shown in FIG. 3, so that the front end of the action spring enters and engages the groove 42. The spring retaining construction shown in FIG. 3 may be preferred where the mass 18 is formed from a relatively hard-to-machine metal such as tungsten, having a density greater than steel and thus preferred for buffer assemblies used in rifles such as the CAR-15 having a relatively short travel of the bolt assembly in recoil.

Figure 4:
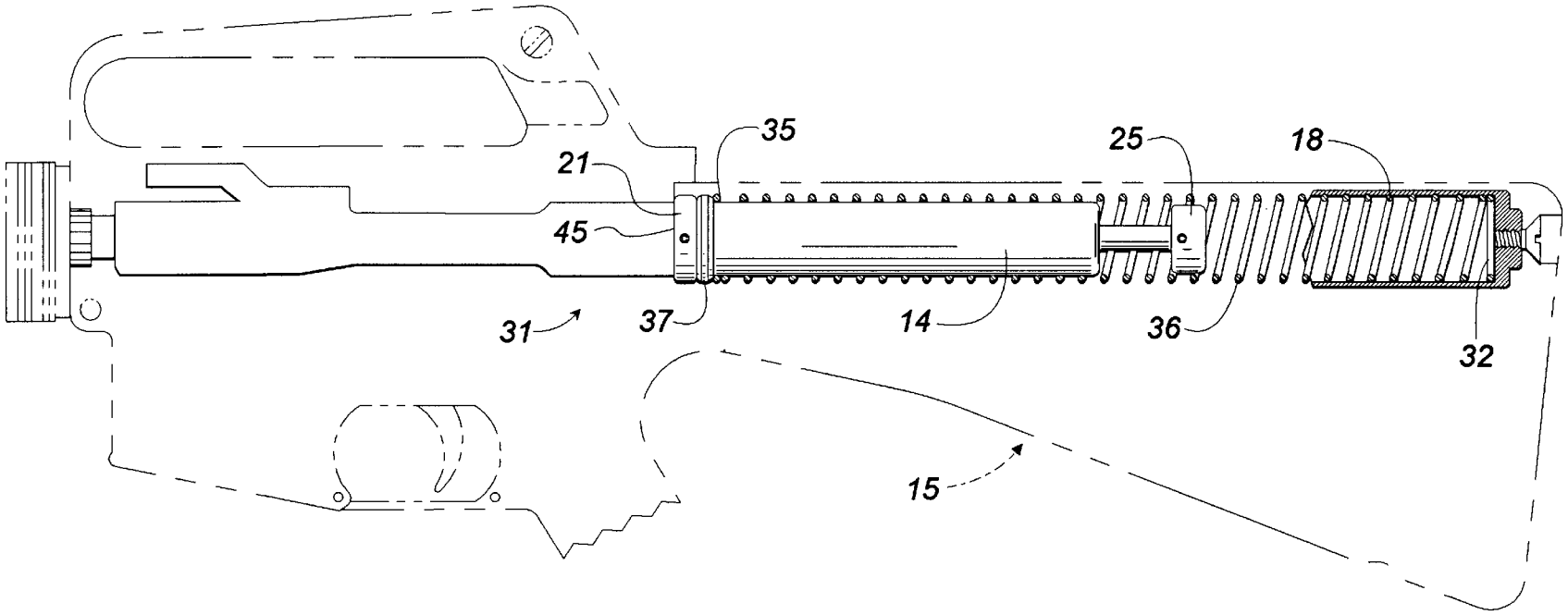
FIG. 4 is a fragmentary and partially-sectioned view showing the buffer assembly of FIG. 1 installed in an M-16 rifle, with the bolt assembly in the full-forward or battery position.
Figure 5A:
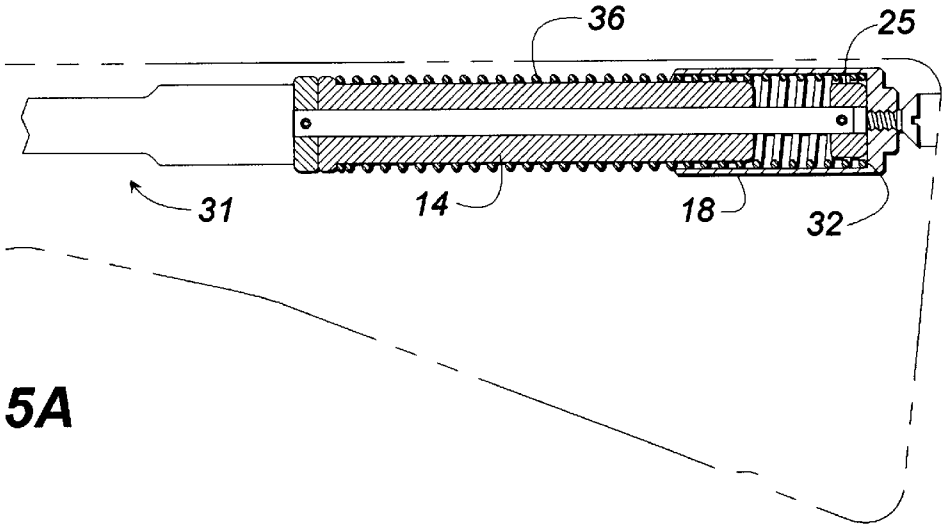
FIG. 5A is a view as in FIG. 4, wherein the bolt assembly has arrived at its full-recoil position.
Figure 5B:
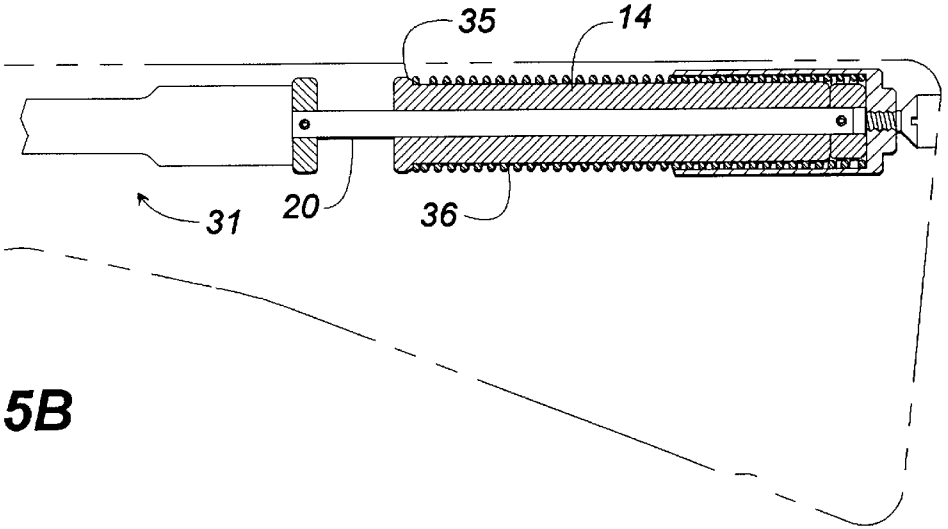
FIG. 5B is a view as in FIG. 4, wherein the bolt assembly remains at full-recoil position while the mass of the buffer assembly has traveled rearwardly.

The operation of the present buffer assembly is now discussed with regard to FIGS. 4, 5A, and 5B. The buffer assembly 10 is a drop-in replacement for the conventional buffer assembly. The front end of the action spring 18 engages the mass 14, urging that mass forwardly on the rod 20 to engage the front buffer 21 of the buffer unit 11. The entire buffer assembly 10 thus is urged forward to contact the back end 45 of the bolt carrier 31, a condition shown in FIG. 4.

When the rifle is fired, the bolt carrier 31 travels rearwardly, and moves the entire buffer assembly rearwardly until the rear buffer 25 contacts the back wall 32 of the action spring tube 18. That contact halts the rearward travel of the bolt carrier 31, which temporarily remains in the position of full recoil shown in FIG. 5A.

While the unit 11 comprising the front buffer 21, the rod 20, and the rear buffer 25 halts the rearward travel of the bolt carrier, the mass 14 continues to travel rearwardly along the rod 20 due to the inertia of the mass. This rearward travel of the mass 14 along the rod 20 continues until the mass contacts the rear buffer 25, a condition shown in FIG. 5B. The action spring 36, which at this time is in maximum compression, then commences moving the mass 14 forwardly along the rod 20 until the mass returns to contact the front buffer 21. At that point the force of the action spring is imparted through the moving mass 14 to the front buffer 21 and to the bolt carrier 31, so that the bolt carrier commences forward travel from the full-recoil position. The bolt carrier 31 thus returns to the battery position in the conventional manner, under the force of the action spring 36. If the rifle is set for full-automatic fire and the shooter continues to pull the trigger, the rifle then will fire another round and the described operating cycle repeats.

It should now be understood that the cycling movement of the bolt carrier 31 is delayed while the mass 14 travels rearwardly under its inertia from the position shown in FIG. 5A to contact the rear buffer 25 and then returns forwardly by the action spring to contact the front buffer 21. The time required for this round-trip movement of the mass 14, relative to the unit 11 of the buffer assembly 10, is the time by which each operating cycle of the firearm is increased. The cyclic rate of firing of the weapon thus is reduced in relation to that increased cycle time. A buffer as described above will reduce the cyclic rate of an M-16 rifle from the normal rate of 750 RPM to a rate of approximately 500 RPM, without modifying the rifle (except for exchanging buffer assemblies) and without affecting the reliability of the weapon.

Figure 6:
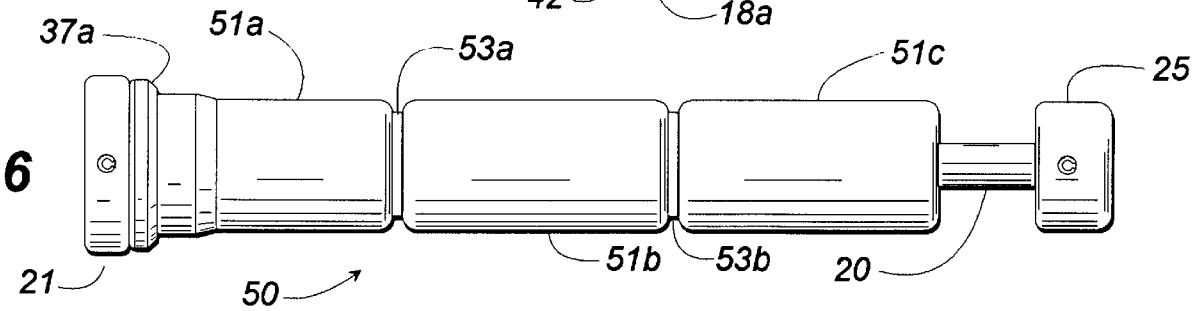
FIG. 6 is a pictorial view showing a buffer assembly according to an alternative of the present invention.

FIG. 6 shows a buffer assembly 50 according to a second embodiment of the present invention. The buffer assembly 50 substitutes plural separate weights such as the thre weights 51*a*, 51*b*, and 51*c* for the single unitary mass 14 used in the embodiment of FIG. 1. Each weight 51*a*–51*c* is slideably mounted in tandem on the rod 20 extending between the front buffer 21 and the rear buffer 25, in the same way as the unitary mass 14 described above. Separate washers 53*a*, 53*b* are interposed between adjacent pairs of weights 51*a*, 51*b* and 51*b*, 51*c*. The washers may be fabricated from a suitable elastomeric material such as polyurethane or the like, as are the front buffer 21 and the rear buffer 25 attached to opposite ends of the rod 20 in both preferred embodiments disclosed herein. The diameter of each individual weight 51*a* . . . is less than the inside diameter of the action spring 18, allowing the weights to reciprocate within the action spring without interference. However, only the weight 51*a* closest to the front buffer 21 has a flange 37*a* for engaging the forward end of the action spring. When the buffer assembly 51 is installed in a rifle, the action spring thus acts only on the frontmost weight 51*a*, leaving the remaining weights 51*b* . . . free for sliding movement in either direction along the rod 20.

The modified buffer assembly 50 is intended to minimize occurrence of bolt bounce or rebound, which may interfere with dependable operation of a firearm such as the M-16 rifle. Bolt bounce occurs when the forward end of the bolt carrier suddenly strikes a confronting steel surface when the bolt carrier reaches the battery position. The bolt carrier momentarily bounces or rebounds from the full-forward position, and this rebound may cause a misfire to occur in full-automatic firing if the hammer of the rifle strikes the firing pin during rebound.

The buffer assembly 50 operates in the following manner to reduce the likelihood of bolt bounce. During recoil movement of the bolt carrier, the buffer assembly 50 operates as described above with respect to the buffer assembly 10 to reduce the cyclic rate of fire. However, after the individual weights 51*a* . . . 51*c* move by inertia to the full-rear position, the action spring 18 returns only the frontmost weight 51*a* forwardly along the rod 20 to contact the front buffer 21. Because the remaining weights 51*b* . . . do not engage the action spring, the inertia of those weights keeps them at the back end of the rod 20 as the action spring returns the buffer assembly 50 and the bolt carrier to battery position. Forward movement of the rod 20 and the front weight 51*a* suddenly stops when the bolt carrier arrives at battery, but the weights 51*b* . . . continue their forward movement, now sliding forwardly along the rod 20 of the buffer assembly 50. Those weights 51*b* . . . strike the frontmost weight 51*a*, imparting their momentum through the front weight and the front buffer 21 to the bolt carrier shortly after the bolt carrier arrives at battery, thereby canceling the rearward bounce force that otherwise would cause the bolt carrier to rebound. The washers 53*a* and 53*b* buffer the impact of each subsequent weight 51*c* . . . on the preceding weight, and help maintain the individual weights as separate entities along the rod 11 to prevent those weights from clustering together and becoming the functional equivalent of the single mass 14 in the buffer assembly embodiment of FIG. 1.

It should be apparent that the foregoing relates only to preferred embodiments of the present invention, and that numerous changes and modifications thereto may be made without departing from the spirit and scope of the invention as defined in the following claims.

What is claimed is:

1. An improved buffer for a firearm capable of full-automatic operation at a certain cyclic rate of fire and having a bolt assembly that reciprocates in a longitudinal region between a battery position and a recoil position, and an action spring urging the bolt assembly toward the battery position, the buffer being received in the region for movement with the bolt assembly and comprising:

elongate means having a front end for contacting the bolt assembly and a rear end spaced longitudinally from the front end for contacting a stop associated with the region when the bolt assembly undergoes a predetermined movement to the recoil position, thereby preventing further rearward movement of the bolt assembly;

a mass carried on the elongate means and slidable therealong a certain distance between the front and rear ends thereof; and the mass having means for engagement by the action spring so that the action spring biases the mass toward the front end of the elongate means and urges the elongate means to contact the bolt assembly in the battery position, the spring maintaining the mass at the front end of the elongate means while the bolt assembly moves in recoil until the rear end contacts the stop, and the mass thereafter continuing to move toward the rear end by inertia and against bias of the action spring, whereby the bolt assembly is delayed in returning from the recoil position to the battery position while the mass moves rearwardly by inertia and then moves forwardly by the action spring to the front end of the elongate means, thereby reducing the cyclic rate of fire.

2. An improved buffer for a firearm capable of full-automatic operation at a certain cyclic rate of fire and having a bolt assembly that reciprocates in a longitudinal region between a battery position and a recoil position, and an action spring urging the bolt assembly toward the battery position, the buffer being received in the region for movement with the bolt assembly and comprising:

an elongate member having a front end for contacting the bolt assembly and a rear end spaced longitudinally from the front end for contacting a stop associated with the region when the bolt assembly undergoes a predetermined movement to the recoil position, thereby preventing further rearward movement of the bolt assembly;

a mass carried on the elongate member and slidable therealong a certain distance between the front and rear ends thereof; and the mass having an element for engagement by the action spring so that the action spring biases the mass toward the front end of the elongate member and urges the elongate member to contact the bolt assembly in the battery position, the spring maintaining the mass at the front end of the elongate member while the bolt assembly moves in recoil until the rear end contacts the stop, and the mass thereafter continuing to move toward the rear end by inertia and against bias of the action spring;

whereby the bolt assembly is delayed in returning from the recoil position to the battery position while the mass moves rearwardly by inertia and then moves forwardly by the action spring to the front end of the elongate member, thereby reducing the cyclic rate of fire.

3. Apparatus as in claim 2, wherein:

the mass is configured to fit within one end of the action spring so that the action spring surrounds a portion of the mass; and the element for engaging the action spring comprises a region of enlarged diameter relative to the portion surrounded by the action spring, whereby the action spring presses against the enlarged region to bias the mass toward the front end of the elongate member.

4. An improved buffer for a firearm capable of full-automatic operation at a certain cyclic rate of file and having a bolt assembly that reciprocates in a longitudinal region between a battery position and a recoil position, and an action spring compressed as the bolt assembly moves to the recoil position, the buffer being received in the region for movement with the bolt assembly and comprising:

a rod having a front portion for contacting the bolt assembly and a rear portion spaced apart from the front portion for contacting a stop associated with the region when the bolt assembly moves rearwardly in recoil to a predetermined position of full recoil, the rod thereby preventing further rearward movement of the bolt assembly; and means slidable along the rod for continued rearward movement while further compressing the action spring after the bolt assembly reaches full recoil so that the continued rearward movement of the means to the position of full recoil, followed by forward movement of the means by the action spring to the front portion of the rod, delays the bolt assembly in returning to the battery position, thereby increasing the time required for the bolt assembly to cycle between rounds and thus reducing the cyclic rate of fire.

5. An improved buffer for a firearm capable of full-automatic operation at a certain cyclic rate of fire and having a bolt assembly that reciprocates in a longitudinal region between a battery position and a recoil position, and an action spring urging the bolt assembly toward the battery position, the buffer being received in the region for movement with the bolt assembly and comprising:

an elongate member comprising a rod having a front end for contacting the rear end spaced longitudinally from the front end for contacting a stop associated with the region when the bolt assembly undergoes a predetermined movement to the recoil position, thereby preventing further rearward movement of the bolt assembly;

a mass concentric with the rod and slidable therealong a certain distance between the front and rear ends thereof;

the mass having an element for engagement by the action spring so that the action spring biases the mass toward the front end of the elongate member and urges the elongate member to contact the bolt assembly in the battery position, the spring maintaining the mass at the front end of the elongate member while the bolt assembly moves in recoil until the rear end contacts the stop, and the mass thereafter continuing to move toward the rear end by inertia and against bias of the action spring, whereby the bolt assembly is delayed in returning from the recoil position to the battery position while the mass moves rearwardly by inertia and then moves forwardly by the action spring to the front end of the elongate member, thereby reducing the cyclic rate of fire.

6. Apparatus as in claim 5, further comprising:

a resilient buffer disposed at each end of the rod, the buffer at the front end being operative for said contact with the bolt assembly and the buffer at the rear end being operative for said contact with the stop.

7. Apparatus as in claim 6, wherein:

a front end of the rod extends through an opening in the front buffer and is substantially flush with a front surface of the front buffer, so that the front surface of the front buffer and the front end of the rod contact the bolt assembly.

8. Apparatus as in claim 6 wherein:

a rear end of the rod extends less than completely through the longitudinal extent of the rear buffer, so that the rear end of the rod does not strike the stop when a rear surface of the rear buffer contacts the stop.

9. An improved buffer for a firearm capable of full-automatic operation at a certain cyclic rate of fire and having a bolt assembly that reciprocates in a longitudinal region between a battery position and a recoil position, and an action spring urging the bolt assembly toward the battery position, the buffer being received in the region for movement with the bolt assembly and comprising:

an elongate member having a front end for contacting the bolt assembly and a rear end spaced longitudinally from the front end for contacting a stop associated with the region when the bolt assembly undergoes a predetermined movement to the recoil position, thereby preventing further rearward movement of the bolt assembly;

a mass operatively associated with the elongate member and movable relative thereto a certain distance between the front and rear ends thereof;

the mass having an element for engagement by the action spring so that the action spring biases the mass toward the front end of the elongate member and urges the elongate member to contact the bolt assembly in the battery position, the spring maintaining the mass at the front end of the elongate member while the bolt assembly moves in recoil until the rear end contacts the stop, and the mass thereafter continuing to move toward the rear end by inertia and against bias of the action spring;

the mass being configured to fit within one end of the action spring so that the action spring surrounds a portion of the mass; and the element for engaging the action spring comprising a region of reduced diameter relative to the remainder of the portion surrounded by the action spring, so that a part of the action spring is received in the region of reduced diameter to engage the mass for biasing the mass toward the front end of the elongate member, whereby the bolt assembly is delayed in returning from the recoil position to the battery position while the mass moves rearwardly by inertia and then moves forwardly by the action spring to the front end of the elongate member, thereby reducing the cyclic rate of fire.

10. Apparatus as in claim 9, wherein:

the region of reduced diameter comprises a groove formed in the mass and operative to retain an end of the action spring for biasing the mass toward the front end of the elongate member.

11. An improved buffer for a firearm capable of full-automatic operation at a certain cyclic rate of fire and having a bolt assembly that reciprocates in a longitudinal region between a battery position and a recoil position, and an action spring urging the bolt assembly toward the battery position, the buffer being received in the region for movement with the bolt assembly and comprising:

an elongate member having a front end for contacting the bolt assembly and a rear end spaced longitudinally from the front end for contacting a stop associated with the region when the bolt assembly undergoes a predetermined movement to the recoil position, thereby preventing further rearward movement of the bolt assembly;

a mass operatively associated with the elongate member and movable relative thereto a certain distance between the front and rear ends thereof;

the mass having an element for engagement by the action spring so that the action spring biases the mass toward the front end of the elongate member and urges the elongate member to contact the bolt assembly in the battery position, the spring maintaining the mass at the front end of the elongate member while the bolt assembly moves in recoil until the rear end contacts the stop, and the mass thereafter continuing to move toward the rear end by inertia and against bias of the action spring;

the mass comprising a plurality of individual weights serially disposed for movement relative to the elongate member; and the action spring pressing only against the individual weight located closest to the front end, so that the remaining said individual weights can lag behind the closest weight while the action spring returns the buffer assembly and the bolt assembly to battery position, and then can move forwardly to transfer momentum to the bolt carrier opposing rebound of the bolt assembly from battery, whereby the bolt assembly is delayed in returning from the recoil position to the battery position while the mass moves rearwardly by inertia and then moves forwardly by the action spring to the front end of the elongate member, thereby reducing the cyclic rate of fire.

12. Apparatus as in claim 11, further comprising:

an elastomeric element between adjacent said weights, so as to cushion the mutual impact of the adjacent weights moving relative to the elongate member.

13. Apparatus as in claim 1, wherein;

the element for engaging the action spring is associated with the weight closest to the front end of the elongate member, so that the remaining said weights are free to move relative to the elongate member.

* * * * *